US009222219B2

(12) United States Patent
Vuorio et al.

(10) Patent No.: US 9,222,219 B2
(45) Date of Patent: Dec. 29, 2015

(54) BLADE ELEMENT

(71) Applicants: Petteri Vuorio, Helsinki (FI); Ville Ruola, Helsinki (FI); Anders Hawen, Helsinki (FI); Peter Bergqvist, Helsinki (FI); Håkan Sjöström, Helsinki (FI); Christer Hedlund, Helsinki (FI)

(72) Inventors: Petteri Vuorio, Helsinki (FI); Ville Ruola, Helsinki (FI); Anders Hawen, Helsinki (FI); Peter Bergqvist, Helsinki (FI); Håkan Sjöström, Helsinki (FI); Christer Hedlund, Helsinki (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 232 days.

(21) Appl. No.: 13/891,845

(22) Filed: May 10, 2013

(65) Prior Publication Data

US 2013/0306768 A1 Nov. 21, 2013

(30) Foreign Application Priority Data

May 15, 2012 (FI) ..... 20125520

(51) Int. Cl.
*B02C 7/12* (2006.01)
*D21D 1/30* (2006.01)

(52) U.S. Cl.
CPC *D21D 1/306* (2013.01); *B02C 7/12* (2013.01); *D21D 1/30* (2013.01)

(58) Field of Classification Search
CPC ..... B02C 7/13; B02C 18/00; B02C 2/10; B02C 7/182; B02C 7/02; B02C 7/12; D21D 1/006; D21D 1/22; D21D 1/303; D21D 1/30; D21D 1/306; A47J 43/255
USPC ..... 241/261.1, 261.2, 261.3, 296, 298
See application file for complete search history.

(56) References Cited

U.S. PATENT DOCUMENTS

| | | | | |
|---|---|---|---|---|
| 5,039,022 | A | 8/1991 | Nilsson | |
| 6,042,036 | A | 3/2000 | Virving et al. | |
| 6,592,062 | B1 * | 7/2003 | Virving | 241/261.3 |
| 2004/0149844 | A1 * | 8/2004 | Antensteiner | 241/298 |
| 2006/0151648 | A1 * | 7/2006 | Vuorio et al. | 241/261.2 |
| 2007/0057102 | A1 * | 3/2007 | Virving | 241/298 |
| 2007/0084952 | A1 * | 4/2007 | Sjostrom et al. | 241/261.2 |
| 2009/0145990 | A1 * | 6/2009 | Vuorio | 241/261.3 |
| 2010/0270411 | A1 * | 10/2010 | Vuorio et al. | 241/245 |
| 2010/0314476 | A1 * | 12/2010 | Vuorio | 241/101.2 |

FOREIGN PATENT DOCUMENTS

| | | |
|---|---|---|
| EP | 2077352 A1 | 7/2009 |
| GB | 819504 | 9/1959 |
| WO | 9718037 A1 | 5/1997 |

OTHER PUBLICATIONS

Search Report, National Board of Patents and Registration of Finland, for FI20125520, dated Nov. 16, 2012.

* cited by examiner

*Primary Examiner* — Faye Francis
*Assistant Examiner* — Onekki Jolly
(74) *Attorney, Agent, or Firm* — Stiennon & Stiennon

(57) ABSTRACT

A blade element (20) for a conical portion (4) of a stator (2) of a refiner (1). The blade element (20) has a feed end (24), a discharge end (25), and a refining surface (21) which has a feed zone (26) at the feed end (24) of the blade element (20). The feed zone (26) of the blade element (20) has at least one guide groove (29) extending from the feed end (24) toward the discharge end (25) for guiding a flow of material to be refined from the feed end (24) toward the discharge end (25). The depth of the guide groove (29) is arranged to change in a direction transverse in relation to the extending direction of the guide groove (29).

20 Claims, 3 Drawing Sheets

A - A

BLADE ELEMENT

CROSS REFERENCES TO RELATED APPLICATIONS

This application claims priority on Finnish App. No. 20125520, filed May 15, 2012, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to refiners for refining a fibrous material, such as wood or the like, comprising a stator and a rotor having a conical portion. More particularly, the invention relates to a blade element for a conical portion of a stator of a refiner, which blade element comprises a feed end, a discharge end, and a refining surface which comprises a feed zone at the feed end of the blade element.

Refiners are used for processing a fibrous material, such as wood or the like, to produce different fibre pulps. A typical refiner comprises oppositely situated stator and rotor, the stator being fixed and the rotor being arranged to rotate about a shaft such that the rotor rotates or turns relative to the stator. The stator and the rotor comprise refining surfaces typically consisting of blade bars and blade grooves therebetween. The material to be refined is fed into a blade gap provided between the stator and the rotor, whereby the refining surfaces of the stator and the rotor refine the material when the rotor rotates relative to the stator.

There are basically two different kinds of refiners comprising a conical portion. A first kind of refiner comprising a conical portion is provided with both a flat portion and a conical portion, whereby the material is first refined in the flat portion of the refiner and thereafter in the conical portion of the refiner. This kind of refiner comprising both the flat portion and the conical portion is typically used for refining a material having a high consistency. A second kind of refiner comprising a conical portion only comprises a conical portion. This kind of refiner only comprising the conical portion is typically used for refining a material having a low consistency. In the conical portion of the refiner, an end of the conical portion having a smaller diameter provides the feed end of the conical portion, where the material to be refined is fed into the blade gap of the conical portion, and an end of the conical portion having a larger diameter provides a discharge end of the conical portion, where the material already refined is discharged out of the blade gap of the conical portion.

In the refiners having the conical portion, the feed of the material to the blade gap in the conical portion is a limiting factor when considering the production capacity of the refiner. This is the case in both refiner types mentioned above. In the refiners comprising both a flat portion and a conical portion, a transition from the flat portion to the conical portion causes a large open volume where a flow of the material to be refined may stop. In the refiners only comprising the conical portion, the material to be refined is fed into the conical blade gap from a large open volume, whereby no specific pressure is provided to promote the flow of the material into the blade gap. At the same time there typically also occurs a change in the direction of the flow of the material when the material is fed from the large open volume into the blade gap, the change in the direction also hindering the flow of the material to the blade gap of the conical portion.

In order to improve the feed of the material into the conical portion of the refiner, some modifications in the structure of the refining surfaces of the conical stator and the conical rotor have been introduced. When considering the refining surface of the conical rotor, these modifications include increasing the height of the blade bars in the feed zone of the refining surface of the conical rotor. When considering the refining surface of the conical stator, these modifications include providing the feed zone of the refining surface of the stator with shoulder-like guide elements intended for guiding the flow of the material forward from the feed zone. In the refiners only comprising the conical portion, these shoulder-like guide elements typically have the form of a bar while in the refiners comprising both a flat portion and a conical portion these shoulder-like guide elements typically have the form of a triangle. EP publication 0 958 057 B1 also discloses a solution for a refiner comprising both a flat portion and a conical portion. This solution comprises a kind of wings at the feed zone of the refining surface of the conical rotor for throwing the material to be refined toward the refining surface of the conical stator, the feed zone of the refining surface of the conical stator comprising shoulder-like guide elements having the form of triangle to guide the flow of the material forward into the conical blade gap between the stator and the rotor.

SUMMARY OF THE INVENTION

An object of the present invention is to provide a new type of blade element for a conical portion of a stator in refiners comprising a conical portion.

The blade element according to the invention is characterized in that the feed zone of the blade element comprises at least one guide groove extending from the feed end of the blade element toward the discharge end of the blade element for guiding a flow of material to be refined from the feed end toward the discharge end, and that the depth of the guide groove is arranged to change in a direction transverse in relation to the extending direction of the guide groove.

A blade element for a conical portion of a stator of a refiner comprises a feed end, a discharge end and a refining surface which comprises a feed zone at the feed end of the blade element. The feed zone of the blade element comprises at least one guide groove extending from the feed end of the blade element toward the discharge end of the blade element for guiding a flow of material to be refined from the feed end toward the discharge end. Further, the depth of the guide groove is arranged to change in a direction transverse in relation to the extending direction of the guide groove.

When the guide elements for the flow of the material to be refined in the feed zone of the conical portion of the stator is implemented as grooves, the thickness of the blade element for the conical portion of the stator at the area of the feed zone may be minimized. This further means that the height of the blade bar in the conical portion of the rotor can be increased at the area of the feed zone of the conical portion of the stator, whereby the feed of the material to be refined into the conical portion of the refiner may be intensified. The guide grooves are also less susceptible to wear and breakage than the previously known shoulder-like guide elements, whereby the guiding effect provided by the guide grooves remain high longer than the guiding effect provided by the shoulder-like guide elements.

BRIEF DESCRIPTION OF THE DRAWINGS

In the following, the invention will be described in greater detail by means of preferred embodiments with reference to the accompanying drawings.

DESCRIPTION OF THE PREFERRED EMBODIMENTS

Figure 1:
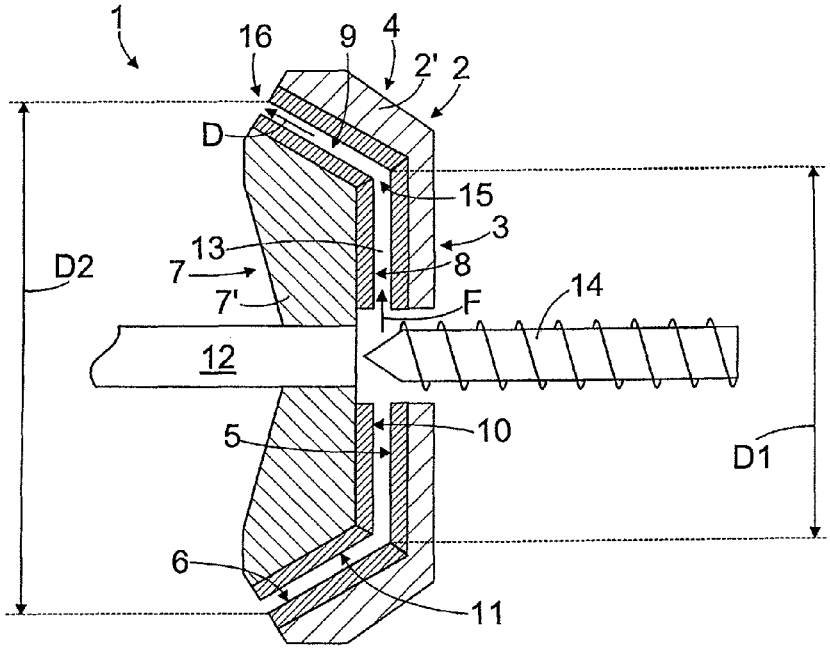
FIG. 1 is a schematic cross-sectional side view of a part of a refiner comprising both a flat portion and a conical portion.

For the sake of clarity, some embodiments of the invention are simplified in the figures. Like reference numerals identify like elements. FIG. 1 is a schematic cross-sectional side view of a part of a refiner 1 intended to be used for refining a fibrous material, such as wood or the like, i.e. a material containing lignocellulose. The refiner 1 comprises a fixed stator 2 having a frame 2' supported to a frame (not shown) of the refiner 1 in FIG. 1. The stator 2 comprises a flat portion 3 and a conical portion 4. The flat portion 3 of the stator 2 comprises a refining surface 5, and the conical portion 4 of the stator 2 comprises a refining surface 6. The refiner 1 further comprises a rotor 7 having a frame 7'. The rotor 7 is arranged to be rotated by a shaft 12 and a motor (not shown). The rotor 7 comprises a flat portion 8 and a conical portion 9. The flat portion 8 of the rotor 7 comprises a refining surface 10, and the conical portion 9 of the rotor 7 comprises a refining surface 11.

The flat portions of the stator 2 and the rotor 7 provide the flat portion 8 of the refiner. The conical portions of the stator 2 and the rotor 7, in turn, provide the conical portion 9 of the refiner 1. The flat portions of the stator and the rotor are arranged substantially perpendicularly to the shaft 12, and the conical portions of the stator and the rotor are arranged at a predetermined angle to the flat portions. The rotor 7 is arranged at a distance from the stator 2 in such a way that a blade gap 13 is left between the refining surfaces 10 and 11 of the rotor 7 and the refining surfaces 5, and 6 of the stator 2. The size of the blade gap 13 may typically be adjusted separately on the flat portion and on the conical portion of the refiner 1.

The fibrous material to be refined is fed by means of a feed screw 14, for example, through the center of the flat portion 3 of the stator 2 to a portion of the blade gap 13 between the flat portion 3 of the stator 2 and the flat portion 8 of the rotor 7, as shown schematically by arrow F. The refining of the material thus starts at the flat portion of the refiner 1. During the refining, the material to be refined proceeds from the blade gap portion on the flat portion of the refiner to the blade gap portion on the conical portion of the refiner 1. The refined material is discharged away from the blade gap 13 at the distal end of the conical portion of the refiner 1, as shown schematically by arrow D.

The conical portion 4 of the stator 2 and the conical portion 9 of the rotor 7 have a first end 15 of a smaller diameter D1 and a second end 16 of a larger diameter D2. The first ends 15 of the conical portions of the stator and the rotor thus provide the first end of the conical portion of the refiner, and the second ends 16 of the conical portion of the stator and the rotor provide the second end of the conical portion of the refiner. The diameters D1 and D2 have been schematically drawn in FIG. 1 at the outermost points of the refining surface 6 of the conical portion 4 of the stator 2. The first ends 15 of the conical portions of the stator and the rotor are directed toward the flat portions of the stator and the rotor, the first ends 15 of the conical portions of the stator and the rotor thus providing feed ends 15 of the conical portions of the stator and the rotor. The second ends 16 of the conical portions of the stator and the rotor are directed away from the flat portions of the stator and the rotor, the second ends 16 of the conical portions of the stator and the rotor thus providing discharge ends 16 of the conical portions of the stator and the rotor.

Figure 2:
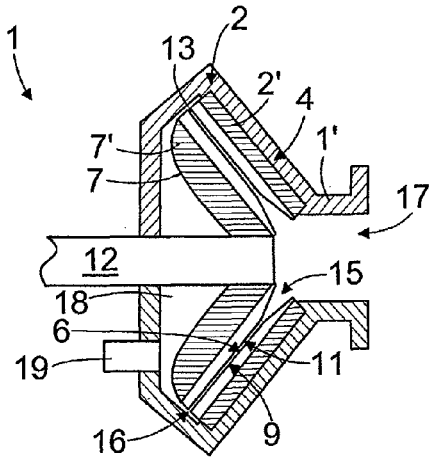
FIG. 2 is a schematic cross-sectional side view of a refiner only comprising a conical portion.

FIG. 2 is a schematic cross-sectional side view of another refiner 1 intended to be used for refining a fibrous material. The refiner 1 comprises a fixed stator 2 having a frame 2' supported to a frame 1' of the refiner 1. The stator 2 only comprises a conical portion 4. The conical portion 4 of the stator 2 comprises a refining surface 6. The refiner 1 further comprises a rotor 7 having a frame 7'. The rotor 7 is arranged to be rotated by a shaft 12 and a motor (not shown). The rotor 7 only comprises a conical portion 9. The conical portion 9 of the rotor 7 comprises a refining surface 11. The rotor 7 is arranged at a distance from the stator 2 in such a way that a blade gap 13 is left between the refining surfaces of the rotor 7 and the stator 2.

The fibrous material to be refined is fed through an open volume 17 in the middle of the stator refining surface 6 to the blade gap 13 at the feed end 15 of the conical portion of the refiner. The refined material exits from the blade gap 13 at the discharge end 16 of the conical portion of the refiner to a refiner chamber 18 and further out of the chamber 18 through an outlet channel 19.

The refiner 1 shown in FIG. 1 and comprising both a flat portion and a conical portion is typically used for refining fibrous materials having high consistencies, such as consistencies above 25% or above 30%. The refiner 1 shown in FIG. 2 and only comprising a conical portion is typically used for refining fibrous materials having low consistencies, such as consistencies below 8% and often below 5%.

Figure 4:
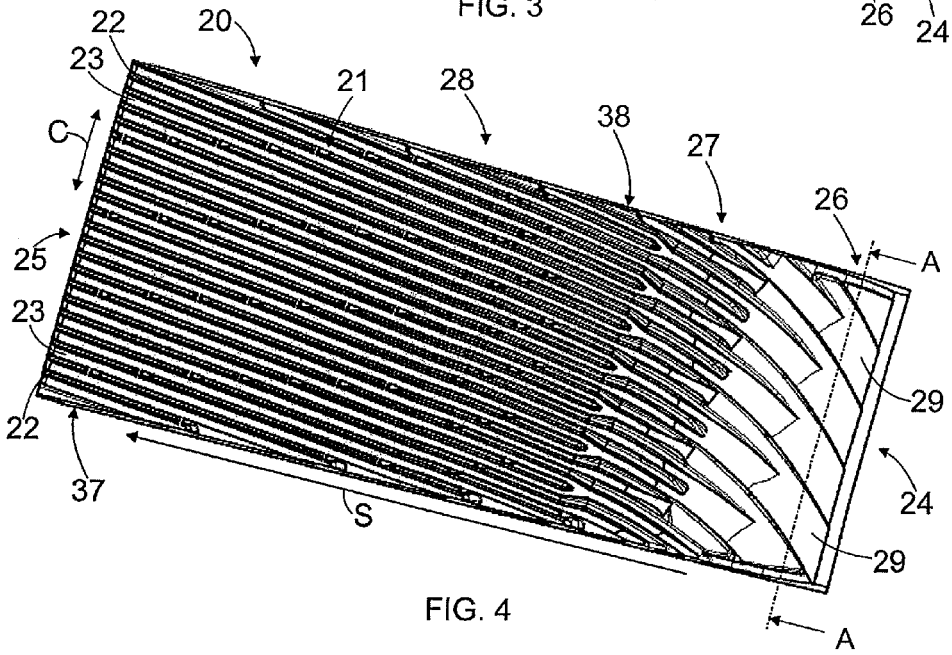
FIG. 4 is a schematic top view of a blade element for the conical portion of the stator of the refiner shown in FIG. 3.

The refining surfaces of the stator and the rotor may be provided by one or more blade elements attached to the frame 2' of the stator 2 or to the frame 7' of the rotor 7. A single blade element may provide the whole refining surface of the flat portion or the conical portion of the stator or the rotor. A single blade element may also provide only a part of the whole refining surface of the flat portion or the conical portion of the stator or the rotor, whereby the whole refining surface of the flat portion or the conical portion of the stator or the rotor is provided by attaching a number of blade elements next to each other. A blade element which provides only a part of a whole refining surface may also be called a blade segment. An example of this kind of blade element is shown schematically in FIG. 4. The blade element 20 in FIG. 4 is intended for forming a part of the refining surface 6 of the conical portion 4 of the stator 2, and it comprises a refining surface 21 having blade bars 22 and blade grooves 23 between them. The blade bars 22 are the parts of the refining surface which actually provide the refining effect on the material to be refined, and the blade grooves 23 are the parts of the refining surface which convey the material to be refined and the material already refined forward in the refining surface. Instead of blade bars 22 and blade grooves 23, the refining surface 21 of the blade element 20 may be provided with other kinds of protrusions and recesses. The structure of the blade element 20 shown in FIG. 4 is explained in more detail next.

Figure 3:
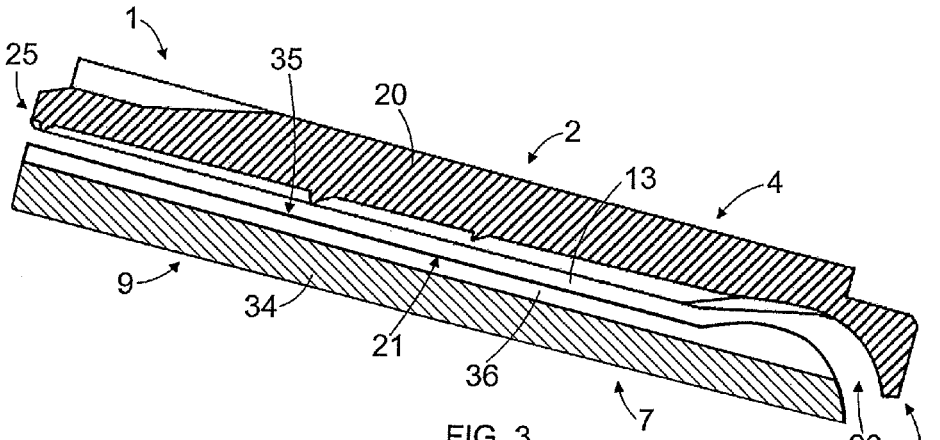
FIG. 3 is a schematic cross-sectional side view of a conical portion of a refiner.
Figure 5:
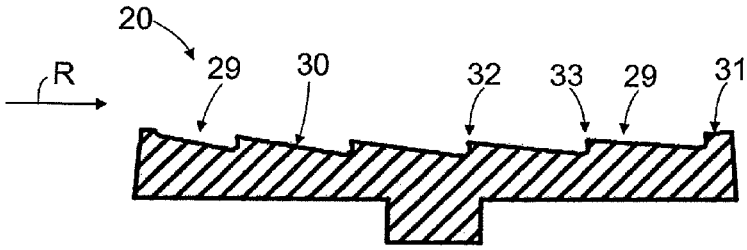
FIG. 5 is a schematic cross-sectional view of the blade element shown in FIG. 4, taken along section line A-A.

FIG. 3 is a schematic cross-sectional side view of a conical portion of a refiner 1, FIG. 4 is a schematic view of the blade element 20 for the conical portion 4 of the stator 2 of the refiner 1 shown in FIG. 3, and FIG. 5 is a schematic cross-sectional view of the blade element 20 shown in FIG. 4, the cross-section being taken along line A-A in FIG. 4. FIG. 3 also schematically shows a blade element 34 for a conical portion 9 of the rotor 7, the blade element 34 comprising a refining surface 35. The blade element 20 shown in FIG. 4 is intended to be used for forming a part of the refining surface 6 of the conical portion 4 of the stator 2, i.e. the refining surface 21 of the blade element 20 forms a part of the refining surface 6 of the conical portion 4 of the stator 2 when the blade element 20 has been installed in the refiner 1. The whole refining surface 6 of the conical portion 4 of the stator 2 is provided by attaching a number of the blade elements 20 next to each other in the circumferential direction of the conical portion 4 of the stator 2 so that the whole circumference of the refining surface 6 of the conical portion 4 of the stator 2 is completed.

The blade element 20 has a feed end 24 and a discharge end 25, the discharge end 25 being an end opposite to the feed end 24, or in other words, the discharge end 25 faces away from the feed end 24. The blade element 20 further comprises a first side edge 37 and a second side edge 38 extending from the feed end 24 to the discharge end 25. The refining surface 21 of the blade element 20 comprises a feed zone 26 arranged at the feed end 24 of the blade element 20 and a first refining zone 27 arranged next to the feed zone 26 toward the direction of the feed end 25. The refining surface 21 of the blade element 20 further comprises a second refining zone 28 next to the first refining zone 27 toward the direction of the discharge end 25. The feed zone 26 is used for providing the feed of the material to be refined toward the first refining zone 27 and the second refining zone 28. The first refining zone 27, where the blade bars 22 are located at a substantially long distance from each other in the circumferential direction of the conical portion of the stator, may be intended for coarse refining, and the second refining zone 28, where the blade bars 22 are located closer to each other in the circumferential direction of the conical portion of the stator, may be intended for fine refining. The number of refining zones may vary according to the intended application of the refiner.

The blade element 20 according to FIG. 4, which is intended to be used for forming a part of a refining surface 6 of a conical portion 4 of a stator 2, may be attached to a conical portion of a frame 2' of the stator 2, which frame 2' of the stator 2 is fixed to a frame 1' of a refiner 1. It is, however, possible that no separate frame 2' of the stator 2 is provided but the blade element 20 is fixed directly to the frame 1' of the refiner 1. In both of these embodiments, the blade element 20 provides a part of the conical portion of the stator.

The blade element 20 of FIG. 4 is intended for providing a whole refining surface 6 of the conical portion 4 of the stator 2 as far as the direction of the refining surface 6 from the feed end 15 of the conical portion 4 of the stator 2 toward the discharge end 16 of the conical portion 4 of the stator 2 is concerned. Consequently, the blade element 20 of FIG. 4 is installed as part of the conical portion 4 of the stator 2 so that the feed end 24 of the blade element 20 is arranged at the feed end 15 of the conical portion 4 of the stator 2, and the discharge end 25 of the blade element 20 is arranged at the discharge end 16 of the conical portion 4 of the stator 2. The embodiment of the blade element 20 may, however, vary, for example in such a way that the blade element 20 only comprises a portion corresponding to the feed zone 26. In such a case, the blade element 20 is installed as part of the conical portion 4 of the stator 2 so that the feed end 24 of the blade element 20 is arranged at the feed end 15 of the conical portion 4 of the stator 2, and the discharge end 25 of the blade element 20 is arranged toward the discharge end 16 of the conical portion 4 of the stator 2.

The feed zone 26 of the blade element 20 comprises guide grooves 29 for guiding the flow of the material to be refined and entering the feed zone 26 forward toward the refining zones 27 and 28. The guide groove 26 is arranged to extend, i.e. to travel or run or proceed, from the direction of the feed end 24 toward the discharge end 25. In the embodiment of FIG. 4, the guide grooves 29 start exactly at the feed end 24 of the blade element 20, but it is also possible that they do not start exactly at the feed end 24 of the blade element 20.

The blade element 20 of FIGS. 4 and 5 comprises five guide grooves 29. In the embodiment of FIGS. 4 and 5, substantially the whole area of the feed zone 26 of the blade element 20 in the circumferential direction of the blade element 20 is covered by the guide grooves 29. The circumferential direction of the blade element 20, which naturally corresponds to the circumferential direction of the conical portion 4 of the stator 2, is schematically denoted by arrow C in FIG. 4. The number of guide grooves 29 in a single blade element may vary, for example because of the size of the diameter of the conical portion of the refiner, the minimum number of guide grooves 29 being one in a single blade element. The number of guide grooves 29 in the feed zone 26 in the conical portion 4 of the stator 2 affects the efficiency of the refiner; consequently, typically at least two guide grooves 29 are provided in the feed zone of a single blade element 20. By having more than one guide groove 29 the guiding effect leads to more even feed distribution toward the refining zones 27 and 28.

The guide groove 29 has a bottom surface 30. The distance of the bottom surface 30 of the guide grooves 29 from a top surface 31 of the blade element 20 at the feed zone 26, i.e. the depth of the guide groove 29, is arranged to change in the transverse direction of the guide groove 29. In the embodiment of FIGS. 4 and 5, the bottom surface 30 of the guide groove 29 is linearly inclined so that the depth of the guide groove changes in a linear way. The depth of the guide groove 29 is arranged to increase in a direction of rotation of the opposing conical portion of the rotor when the blade element 20 has been installed in the conical portion of the stator, or in other words, the depth of the guide groove 29 is arranged to decrease toward an incoming direction of the rotor 7. The rotation direction of the rotor 7 is denoted schematically by arrow R in FIG. 5. The depth of the guide groove 29 at a first groove edge 32 at the incoming direction of the rotor 7 is thus smaller than the depth of the guide groove 29 at a second groove edge 33 at an exit direction of the rotor 7, when the rotor 7 rotates relative to the stator 2. This means that the cross-sectional volume of the guide groove 29 increases in the same direction as the rotation direction R of the rotor 7. It is, however, possible that the depth of the guide groove 29 is arranged to increase toward the incoming direction of the rotor 7, whereby the cross-sectional volume of the guide groove 29 increases toward the opposite direction relative to the rotation direction R of the rotor 7.

The depth of the guide groove may vary for example between 1-12 mm in such a way that the depth of the guide groove at one groove edge is different than at the other groove edge. The width of the guide groove may for example be 10-150 mm, preferably 15-60 mm and more preferably 20-40 mm.

In FIG. 3, it can also be seen that the refining surface 21 of the blade element 20 at the area of the feed zone 26 is arranged to be concave, whereby an abrupt change in the direction of the flow of the material to be refined and entering the conical portion of the refiner 1 may be avoided.

During operation of the refiner 1, the rotor 7 rotates about the stator 2. Referring also to FIG. 3, when the material to be refined enters the conical portion of the refiner 1, blade bars 36 at the conical portion of the rotor at the location of the feed zone 26 in the conical portion of the stator throw the material to be refined toward the feed zone 26 of the blade element 20 in the conical portion 4 of the stator 2. The effect of a blade bar 36 in the conical portion 9 of the rotor 7 may be enhanced if the blade bar 36 has an increased height at the area of the feed zone 26 of the blade element 20 of the conical portion 4 of the stator 2, as is schematically shown in FIG. 3. The material to be refined and thrown toward the conical portion 4 of the stator 2 now enters the guide grooves 29 in the feed zone 26 of the conical portion 4 of the stator 2. In the feed zone 26, the guide groove 29 and especially the bottom surface 30 and the second groove edge 33 of the guide grooves 29 guide or direct the flow of the material along the guide grooves from the direction of the feed end 24 of the blade element 20 toward the discharge end 25 of the blade element 20, i.e. from the direction of the feed end 15 of the conical portion of the refiner 1 toward the discharge end 16 of the conical portion of the refiner 1. When the depth of the guide groove 29 increases in the same direction as the rotation direction R of the rotor 7, the second groove edge 33 has an effective guiding effect on the larger amount of the material if compared with an embodiment wherein the depth of the guide groove 29 increases in a direction opposite to the rotation direction R of the rotor 7. At the same time, however, the total amount of material to be refined in a single guide groove 29 is limited by the changing depth of the guide groove, whereby the material to be refined moves efficiently forward from the feed zone 26 and the risk that the material might get stuck in the guide groove 29 is minimized.

When the elements for guiding the flow of the material to be refined at the feed zone 26 of the conical portion 4 of the stator 2 are implemented as grooves, as disclosed above, the thickness of the blade element 20 for the conical portion 4 of the stator 2 at the area of the feed zone may be minimized. This means that the height of the blade bar 36 in the conical portion 9 of the rotor 7 can be further increased at the area of the feed zone 26 of the conical portion 4 of the stator 2. This has the effect that the blade bars 36 in the conical portion 9 of the rotor 7 throw more efficiently the material to be refined toward the feed zone 26 of the conical portion 4 of the stator 2. In such a case, the conical portion 9 of the rotor 7 may efficiently supply the material to be refined to the conical portion of the refiner, and the feed zone 26 in the conical portion 4 of the stator 2 guides the flow of the material forward in the conical portion of the refiner.

The guide groove 29 may run or extend from the direction of the feed end 24 of the blade element 20 toward the discharge end 25 of the blade element 20 having either a straight form or a curved form. If the guide groove 29 runs from the direction of the feed end 24 toward the discharge end 25 as having a straight form, the guide groove 29 may extend parallel to the direction of the radius of the refining surface 21 of the blade element 20 or as inclined in relation to the direction of the radius of the refining surface 21 of the blade element 20. The radius of the refining surface of a conical portion of a refiner, and thus the radius of the refining surface 21 of the blade element 20 is defined as a projection of the shaft 12 of the refiner 1 to the respective refining surface at the conical portion of the refiner. The direction of the radius of the refining surface 21 of the blade element 20 is schematically denoted by arrow S in FIG. 4, the radius S being parallel to the side edges 37 and 38 of the blade element 20. When the direction of the guide groove is inclined in relation to the direction of the radius of the refining surface 21 of the blade element 20, this inclination angle of the guide groove 20 in the mid length of the feed zone may be 10°-80°, preferably 15°-65° or more preferably 20°-50° and preferably such that the end of the guide groove 29 at the feed end side is directed toward the incoming direction of the rotor 7. Preferably, the guide groove 29 runs from the direction of the feed end 24 toward the discharge end 25 as having a curved form in such a way that the center of the curvature is toward the incoming direction of the rotor 7. In this case, too, the end of the guide groove 29 at the feed end side is preferably directed toward the incoming direction of the rotor 7, whereby no abrupt changes occur in the direction of the flow of the material in the feed zone 26 of the conical portion 4 of the stator 2 so that the material entering the feed zone 26 of the conical portion 4 of the stator maintains as much as possible of its speed at the feed zone 26 of the conical portion 4 of the stator 2.

As the inclination angle of the guide groove relative to the radius S of the refining surface may vary, the transverse direction of the guide groove may be exactly parallel with the circumferential direction of the blade element 20 or the conical portion of the stator or the transverse direction of the guide groove may somewhat differ from the circumferential direction of the blade element 20.

Figure 6:
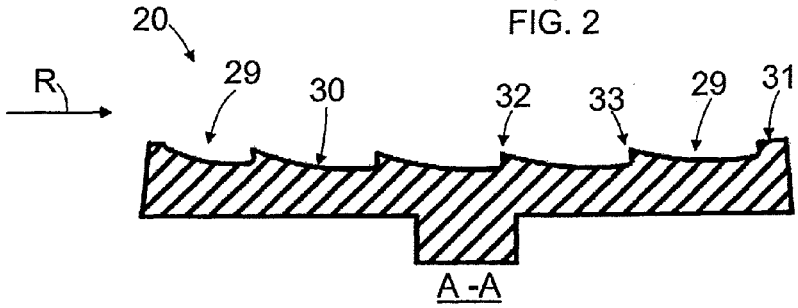
FIG. 6 is a schematic cross-sectional view of another blade element.

FIG. 6 is a schematic cross-sectional view of another blade element 20. In the blade element 20 of FIG. 6, the bottom surface 30 of the guide groove 29 is concave so that the depth of the guide groove 29 changes in a concave way. In the embodiment of FIG. 6, the depth of the guide groove 29 is again arranged to increase in the rotation direction R of the opposing conical portion 9 of the rotor 7 when the blade element 20 has been installed in the conical portion 4 of the stator 2, or in other words, the depth of the guide groove 29 is arranged to decrease toward the incoming direction of the rotor 7. The cross-sectional volume of the guide groove 26 is larger in FIG. 6 than in FIG. 5, which means that the capacity of the refiner provided with a blade element 20 of FIG. 6 may be higher than the capacity of the refiner provided with a blade element of FIG. 5. In addition to the embodiments shown in FIGS. 5 and 6, the bottom surface 30 of the guide groove 29 may also be convex so that the depth of the guide groove 29 changes in a convex way.

The embodiment of the blade element 20 in FIGS. 3 to 6 is intended for providing only a part of the refining surface 6 of the conical portion 4 of the stator 2. The blade element may, however, also be implemented so that a single blade element provides the whole refining surface 6 of the conical portion 4 of the stator 2.

Figure 7:
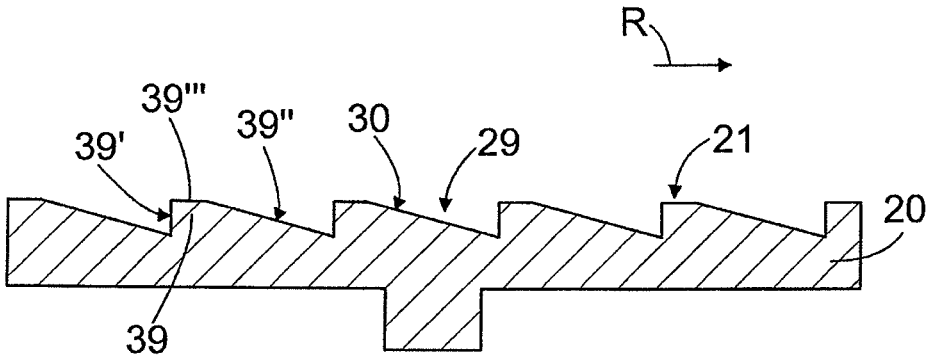
FIG. 7 is a schematic cross-sectional view of a third blade element for the conical portion of the stator of the refiner.

In FIGS. 5, 6 and 7 the cross-section of the blade element 20 has been visualized by having a substantially straight form or construction but in reality the cross-section of the blade element 20 is curved so as to provide a conical refining surface and to fit to a conical surface against which they are assembled.

In the embodiments of the blade element 20 above the feed zone 26 of the blade element 20 only comprises guide grooves 29, i.e. in the embodiments of the blade element 20 above the feed zone 26 of the blade element 20 does not comprise any blade bars.

FIG. 7 schematically shows a cross-sectional view of a third blade element 20 for a conical portion of a stator of a refiner, seen from the feed end 24 of the blade element 20. The refining surface 21 of the blade element 20 comprises in the feed zone 26 blade bars 39, which extend from the direction of the feed end 24 of the blade element 20 toward the discharge end 25 of the blade element 20. The blade bars 39 may start exactly at the feed end 24 of the blade element 20 but it is also possible that they do not start exactly at the feed end 24 of the blade element 20.

The blade bar 39 comprises a first side surface 39' and a second side surface 39", a top surface 39'" of the blade bar 39 remaining between the first 39' and second 39" side surfaces of the blade bar 39. The first side surface 39' of the blade bar 39 is implemented as a substantially vertical surface whereas the second side surface 39" of the blade bar 39 is implemented as a bevel or a slope, which is arranged to descend toward the first side surface 39' of the adjacent blade bar 39 such that the height of the blade bar 39 is arranged to decrease in the area of the second side surface 39" of the blade bar 39 toward the first side surface 39' of the neighbouring blade bar 39.

The sloping second side surface 39" of the blade bar 39 provides a free space or volume between the top surfaces 39'" of two adjacent blade bars 39, whereby this free space or volume provides a guide groove 29, which extends from the direction of the feed end 24 of the blade element 20 toward the discharge end 25 of the blade element 20 for guiding a flow of material to be refined from the feed end 24 toward the discharge end 25. The second side surface 39" of the blade bar 39 provides the bottom surface 30 of the guide groove 29. The depth of the guide groove 29 thus formed is arranged to change in the direction transverse in relation to the extending direction of the guide groove 29. The embodiment of the blade element 20 according to FIG. 7 thus comprises at the feed zone 26 of the blade element 20 only blade bars 39, wherein a side surface of the blade bar 39 is formed to provide the guide groove 29 on the refining surface 21 of the blade element 20.

In the embodiment of FIG. 7 the second side surface 39" of the blade bar 39 is arranged to descend linearly toward the first side surface 39' of the adjacent blade bar 39, whereby the depth of the guide groove 29 thus created is arranged to increase in the rotation direction R of the opposing conical portion of the rotor of the refiner when the blade element 20 of FIG. 7 has been installed in the refiner 1. The second side surface 39" of the blade bar 39 may also be arranged to descend toward the first side surface 39' of the adjacent blade bar 39 either in a concave way or in a convex way. Alternatively, the second side surface 39" of the blade bar 39 may be implemented as a substantially vertical surface and the first side surface 39' may be arranged to descend toward the second side surface 39" of the adjacent blade bar 39, whereby the depth of the guide groove 29 thus created is arranged to decrease in the rotation direction R of the opposing conical portion of the rotor of the refiner when the blade element 20 of FIG. 7 has been installed in the refiner 1. The blade bars 39 at the feed zone 26 of the blade element 20 may be for example intended for coarse refining, whereby possible blade bars at subsequent blade element zones may be intended for fine refining with different refining characteristics. The number of the blade bars 39 at the feed zone 26 of the blade element 20 may be one or more.

It will be apparent to a person skilled in the art that as technology advances, the inventive concept can be implemented in various ways. The invention and its embodiments are not limited to the examples described above but may vary within the scope of the claims.

We claim:

1. A refiner comprising:

a conical stator mounted to the refiner so as to be non-rotating;

an opposed conical rotor, rotably mounted in the refiner so as to rotate with respect to the conical stator;

wherein the conical stator has a conical surface which defines an axis, wherein a radical direction is defined perpendicular to the axis, and wherein a circumferential direction is defined along a circular line generated by a point on a radial line which extends to the conical stator in the radial direction from the axis, when the radial line is rotated about the axis;

a blade element for a part of the conical stator of the refiner;

wherein the blade element has a feed end, a discharge end, a first side, a second side, and a blade refining surface therebetween so that a material to be refined flows from the feed end to the discharge end along the blade refining surface of the blade element and wherein the blade refining surface is between the first side of the second side;

wherein the blade refining surface has a feed zone at the feed end of the blade element;

wherein the feed zone of the blade element has a least one guide groove extending in an extending direction from the feed end of the blade element toward the discharge end of the blade element for guiding a flow of material to be refined from the feed end toward the discharge end;

wherein the at least one guide groove has a depth in the radial direction which is arranged so as to increase in the circumferential direction wherein the depth of the at least one guided groove is arranged so as to increase in a transverse direction defined by the circumferential direction and a direction of rotation of the opposed conical rotor of the refiner.

2. The refiner of claim 1 wherein the feed zone of the blade element comprises at least two guide grooves.

3. The refiner of claim 1 wherein the feed zone of the blade element defines a feed zone area, and wherein all of the feed zone area of the blade element, in the circumferential direction, is covered by the at least one guide groove(s).

4. The refiner of claim 2 wherein in the feed zone, the first side and the second side have adjacent top surfaces between which are the at least two guide grooves, and wherein the adjacent top surfaces are at least as high in the radial direction as any part of the at least two blade grooves.

5. The refiner of claim 1 wherein the at least one guide groove has a linearly inclined bottom surface so that the depth of the at least one guide groove changes linearly across the at least one guide groove.

6. The refiner of claim 1 wherein the at least one guide groove has a concave bottom surface so that the at least one guide groove changes according to the concavity of the concave bottom surface.

7. The refiner of claim 1 wherein the at least one guide groove is arranged to extend from the feed end of the blade element toward the discharge end of the blade element along a curve defining a center of curvature, wherein the center of curvature is arranged in a direction opposite the first direction.

8. The refiner of claim 7 wherein the at least one guide groove has a guide groove end, at the feed end of the blade element; and wherein the guide groove end is arranged toward the direction opposite to the first direction.

9. The refiner of claim 1 wherein the feed zone of the blade element comprises at least one blade bar, the at least one blade bar having a side surface of the at least one blade bar having a shape which forms the at least one guide groove.

10. A refiner comprising:

a stator having at least a conical portion, wherein said conical portion has a conical surface which defines an axis about which the conical surface forms part of a surface of revolution, wherein a radical direction is defined perpendicular to the axis, and wherein a circumferential direction is defined along a circular line generated by a point on a radical line which extends in the radial direction from the axis, when the radial line is rotated about the axis;

a rotor having at least a conical portion;

wherein the rotor is arranged to rotate in a first direction with respect to the stator and the first direction defines a transverse direction in the circumferential direction;

wherein the conical portion of the stator comprises at least one blade element having a feed end, a discharge end, and a refining surface therebetween;

wherein the refining surface has a feed zone at the feed end of the blade element;

wherein the feed zone of the blade element has at least one guide groove extending in an extending direction from the feed end of the blade element toward the discharge end of the blade element for guiding a flow of material to be refined from the feed end toward the discharge end; and wherein the at least one guide groove has a depth in the radial direction which increases in the transverse direction.

11. The refiner of claim 10 wherein the stator has a flat portion in addition to the conical portion; and wherein the rotor of the refiner has a flat portion in addition to the conical portion.

12. The refiner of claim 10 wherein the feed zone of the blade element comprises at least two guide grooves.

13. The refiner of claim 10 wherein the feed zone of the blade element defines a feed zone area, and wherein all of the feed zone area of the blade element, in a circumferential direction of the blade element, is covered by the at least one guide groove(s).

14. The refiner of claim 10 wherein the feed zone of the blade element comprises at least two guide grooves; and wherein in the feed zone, the first side and the second side have adjacent top surfaces between which are the at least two guide grooves, and wherein the adjacent top surfaces are at least as high in the radial direction as any part of the at least two blade grooves.

15. The refiner of claim 10 wherein the at least one guide groove has a linearly inclined bottom surface so that the depth of the at least one guide groove changes linearly across the at least one guide groove.

16. The refiner of claim 10 wherein the at least one guide groove has a concave bottom surface so that the guide groove depth changes according to the concavity of the concave bottom surface.

17. The refiner of claim 10 wherein the at least one guide groove is arranged to extend from the feed end of the blade element toward the discharge end of the blade element along a curve defining a center of curvature; and wherein when the blade element is installed in a refiner, the center of curvature is arranged in a direction opposite the transverse direction.

18. The refiner of claim 17 wherein the at least one guide groove has an end at the feed end of the blade element; and wherein the guide groove end is arranged toward the direction opposite to the transverse direction.

19. The refiner of claim 10 wherein the feed zone of the blade element comprises at least one blade bar, the at least one blade bar having a side surface of the at least one blade bar having a shape which forms the at least one guide groove.

20. A refiner comprising:

a stator having at least a conical portion, wherein said conical portion has a conical surface which defines an axis about which the conical surface forms part of a surface of revolution, wherein a radial direction is defined perpendicular to the axis, and wherein a circumferential direction is defined along a circular line generated by a point on a radial line which extends in the radial direction from the axis, when the radial line is rotated about the axis;

a rotor having at least a conical portion;

wherein the rotor is arranged to rotate in a first direction with respect to the stator and the first direction defines a transverse direction in the circumferential direction;

wherein the conical portion of the stator comprises at least one blade element;

wherein the blade element has a feed end, a discharge end, and a first refining surface at the feed end having a plurality of guide grooves and at least a second refining surface between the first refining surface and the discharge end and wherein the second refining surface has at least twice as many grooves formed between refining bars as the first refining surface has guide grooves;

wherein the first refining surface at the feed end forms a feed zone of the blade element, the feed zone including the first refining surface plurality of guide grooves, the guide grooves extending from the feed end of the blade element toward the discharge end of the blade element for guiding a flow of material to be refined from the feed end to the second refining surface; and wherein the guide grooves have a depth in the radial direction which increases in the transverse direction.

* * * * *

UNITED STATES PATENT AND TRADEMARK OFFICE

CERTIFICATE OF CORRECTION

PATENT NO. : 9,222,219 B2
APPLICATION NO. : 13/891845
DATED : December 29, 2015
INVENTOR(S) : Petteri Vuorio et al.

It is certified that error appears in the above-identified patent and that said Letters Patent is hereby corrected as shown below:

In The Claims

Column 10, line 5, "conical rotor rotably mounted" should be -- conical rotor rotatably mounted --.

Column 10, line 9, "wherein a radical direction" should be -- wherein a radial direction --.

Column 10, line 23, "between the first side of the second side" should be -- between the first side and the second side --.

Column 10, line 26, "the blade element has a least" should be -- the blade element has at least --.

Column 10, line 35, "at least one guided groove" should be -- at least one guide groove --.

Column 11, line 11, "wherein a radical direction" should be -- wherein a radial direction --.

Column 11, line 14, "a point on a radical line" should be -- a point on a radial line --.

Signed and Sealed this
First Day of March, 2016

Michelle K. Lee

Michelle K. Lee
*Director of the United States Patent and Trademark Office*